US006523360B2

(12) United States Patent
Watanabe et al.

(10) Patent No.: US 6,523,360 B2
(45) Date of Patent: Feb. 25, 2003

(54) COOLING CYCLE AND CONTROL METHOD THEREOF

(75) Inventors: Toshiharu Watanabe, Tochigi (JP); Torahide Takahashi, Gunma (JP); Yoshihiro Sasaki, Tochigi (JP); Masahiro Iguchi, Saitama (JP); Kojiro Nakamura, Tochigi (JP); Yasuhito Okawara, Tochigi (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/984,678

(22) Filed: Oct. 30, 2001

(65) Prior Publication Data

US 2002/0050143 A1 May 2, 2002

(30) Foreign Application Priority Data

Oct. 30, 2000 (JP) ..... 2000-330361

(51) Int. Cl.[7] ..... F25B 1/00; F25B 49/00
(52) U.S. Cl. ..... 62/204; 62/228.3; 62/513
(58) Field of Search ..... 62/204, 228.3, 62/513, 113, 208, 209, 210

(56) References Cited

U.S. PATENT DOCUMENTS

| | | | | | |
|---|---|---|---|---|---|
| 5,245,836 | A | | 9/1993 | Lorentzen et al. | 62/174 |
| 5,890,370 | A | | 4/1999 | Sakakibara et al. | 62/222 |
| 6,073,454 | A | * | 6/2000 | Spauschus et al. | 62/114 |
| 6,092,379 | A | * | 7/2000 | Nishida et al. | 62/200 |
| 6,105,386 | A | * | 8/2000 | Kuroda et al. | 62/513 |
| 6,112,547 | A | * | 9/2000 | Spauschus et al. | 62/476 |
| 6,134,900 | A | * | 10/2000 | Nishida et al. | 62/216 |
| 6,178,761 | B1 | | 1/2001 | Karl | 62/159 |
| 6,260,367 | B1 | * | 7/2001 | Furuya et al. | 62/197 |
| 6,341,496 | B1 | * | 1/2002 | Kettner et al. | 62/225 |
| 6,343,486 | B1 | * | 2/2002 | Mizukami | 62/509 |
| 2001/0003311 | A1 | * | 6/2001 | Karl | 165/202 |

FOREIGN PATENT DOCUMENTS

| | | | | |
|---|---|---|---|---|
| DE | 196 31 914 | | 2/1997 | |
| EP | 0 837 291 | | 4/1998 | |
| EP | 0 931 991 | | 7/1999 | |
| EP | 0 960 755 | | 12/1999 | |
| EP | 1 014 013 | | 6/2000 | |
| JP | 7-18602 | | 3/1995 | |
| JP | 09-049662 | A * | 2/1997 | F25B/1/00 |
| JP | 2000-206780 | | 7/2000 | |
| JP | 2000-213819 | | 8/2000 | |
| WO | 90/07683 | | 7/1990 | |

* cited by examiner

*Primary Examiner*—Denise L. Esquivel
*Assistant Examiner*—Marc Norman
(74) *Attorney, Agent, or Firm*—Foley & Lardner

(57) ABSTRACT

A cooling cycle with a high-pressure side operating in a supercritical area of refrigerant includes a temperature sensor for sensing a temperature of cooled refrigerant between a gas cooler and an internal heat exchanger, a pressure sensor for sensing a pressure of cooled refrigerant between the two, and a controller for controlling at least one of a compressor and a throttling device in accordance with the sensed temperature and the sensed pressure.

18 Claims, 6 Drawing Sheets

COOLING CYCLE AND CONTROL METHOD THEREOF

BACKGROUND OF THE INVENTION

The present invention relates to a cooling cycle suited for use in automotive air-conditioning systems and a control method thereof More particularly, the present invention relates to a cooling cycle using a supercritical or transcritical refrigerant such as $CO_2$ and a control method thereof.

The cooling cycle for automotive air conditioners uses a fluorocarbon refrigerant such as CFC12, HFC134a, or the like. When released into the atmosphere, fluorocarbons can destroy an ozone layer and cause environmental problems such as global warming. On this account, the cooling cycle has been proposed which uses $CO_2$, ethylene, ethane, nitrogen oxide, or the like in place of fluorocarbons.

The cooling cycle using $CO_2$ refrigerant is similar in operating principle to the cooling cycle using fluorocarbon refrigerant except for the following: since the critical temperature of $CO_2$ is about 31° C., which is remarkably lower than that of a fluorocarbon (e.g., 112° C. for CFC12), the temperature of $CO_2$ in a gas cooler or condenser becomes higher than the critical temperature thereof in the summer months where the outside-air temperature rises, for example, $CO_2$ does not condense even at an outlet of the gas cooler.

The conditions of the outlet of the gas cooler are determined in accordance with the compressor discharge pressure and the $CO_2$ temperature at the gas-cooler outlet. The $CO_2$ temperature at the gas-cooler outlet is determined in accordance with the heat-radiation capacity of the gas cooler and the outside-air temperature. However, since the outside-air temperature cannot be controlled, the $CO_2$ temperature at the gas-cooler outlet cannot be controlled practically. On the other hand, since the gas-cooler-outlet conditions can be controlled by regulating the compressor discharge pressure, i.e., the refrigerant pressure at the gas-cooler outlet, the refrigerant pressure at the gas-cooler outlet is increased to secure sufficient cooling capacity or enthalpy difference during the summer months where the outside-air temperature is higher.

Specifically, the cooling cycle using a fluorocarbon refrigerant has 0.2–1.6 MPa refrigerant pressure in the cycle, whereas the cooling cycle using $CO_2$ refrigerant has 3.5–10.0 MPa refrigerant pressure in the cycle, which is remarkably higher than in the fluorocarbon cooling cycle.

An attempt has been made in the cooling cycle using supercritical refrigerant to enhance the ratio of the cooling capacity of an evaporator to the workload of a compressor, i.e., coefficient of performance (COP). U.S. Pat. No. 5,245,836 issued Sep. 21, 1993 to Lorentzen, et al. proposes an enhancement in COP by carrying out heat exchange between the refrigerant that has passed through the evaporator and the supercritical-area refrigerant that is present in a high-pressure line. In the cooling cycle including such an internal heat exchanger, refrigerant is further cooled by the heat exchanger to reach a throttling valve. This leads to still lower temperature of the refrigerant at an inlet of the throttling valve, which provides maximum COP.

In connection with the cooling cycle including an internal heat exchanger, JP-A 2000-213819 describes a method of controlling a throttling valve arranged upstream of an evaporator. This method allows control of the refrigerant temperature and pressure at the throttling-valve inlet to provide maximum COP.

However, such method of controlling the operating conditions of the compressor in accordance with the refrigerant temperature and pressure at the throttling-valve inlet raises the following inconvenience. Even when the outside-air temperature is constant, a variation in the air temperature in a cabin of a vehicle causes a variation in the heat receiving amount in the internal heat exchanger, which makes control providing maximum COP impossible.

Moreover, our study reveals that the conditions of providing maximum COP do not always correspond to those of providing maximum cooling capacity. An enhancement in COP is desirable in view of efficient operation of the cooling cycle. However, when it is desirable to give high priority to the cooling capacity, the operation of the cooling cycle under the maximum COP providing conditions cannot provide a target maximum cooling capacity.

SUMMARY OF THE INVENTION

It is, therefore, an object of the present invention to provide a cooling cycle for use in automotive air-conditioning systems, which can fulfill the most favorable performance in the operating environments. Another object of the present invention is to provide a control method of such cooling cycle.

The present invention provides generally a cooling cycle with a high-pressure side operating in a supercritical area of a refrigerant, comprising:

a compressor that compresses the refrigerant;

a gas cooler that cools the compressed refrigerant;

a throttling device that throttles flow of the cooled refrigerant;

an evaporator that cools intake air by a heat absorbing action of the cooled refrigerant;

an internal heat exchanger that carries out heat exchange between the cooled refrigerant and the refrigerant that passed through the evaporator;

a temperature sensor that senses a temperature of the cooled refrigerant between the gas cooler and the internal heat exchanger;

a pressure sensor that senses a pressure of the cooled refrigerant between the gas cooler and the internal heat exchanger; and a controller that controls at least one of the compressor and the throttling device in accordance with the sensed temperature of the cooled refrigerant and the sensed pressure of the cooled refrigerant.

An aspect of the present invention is to provide a method of controlling a cooling cycle with a high-pressure side operating in a supercritical area of a refrigerant, the cooling cycle comprising:

a compressor that compresses the refrigerant;

a gas cooler that cools the compressed refrigerant;

a throttling device that throttles flow of the cooled refrigerant;

an evaporator that cools intake air by a heat absorbing action of the cooled refrigerant; and an internal heat exchanger that carries out heat exchange between the cooled refrigerant and the refrigerant that passed through the evaporator, the method comprising:

sensing a temperature of the cooled refrigerant between the gas cooler and the internal heat exchanger and a pressure of the cooled refrigerant between the gas cooler and the internal heat exchanger;

determining a control pattern of the cooling cycle in accordance with operating environments of the cooling cycle; and controlling at least one of the compressor and the throttling device in accordance with the determined control pattern, the controlling step allowing adjustment of the temperature of the cooled refrigerant and the pressure of the cooled refrigerant.

BRIEF DESCRIPTION OF THE DRAWINGS

The other objects and features of the present invention will become apparent from the following description with reference to the attached drawings, wherein.

DETAILED DESCRIPTION OF THE INVENTION

In a cooling cycle according to the present invention, a throttling device or means and/or a compressor is controlled in accordance with the temperature and pressure of refrigerant between a gas cooler and an internal heat exchanger.

Figure 4:
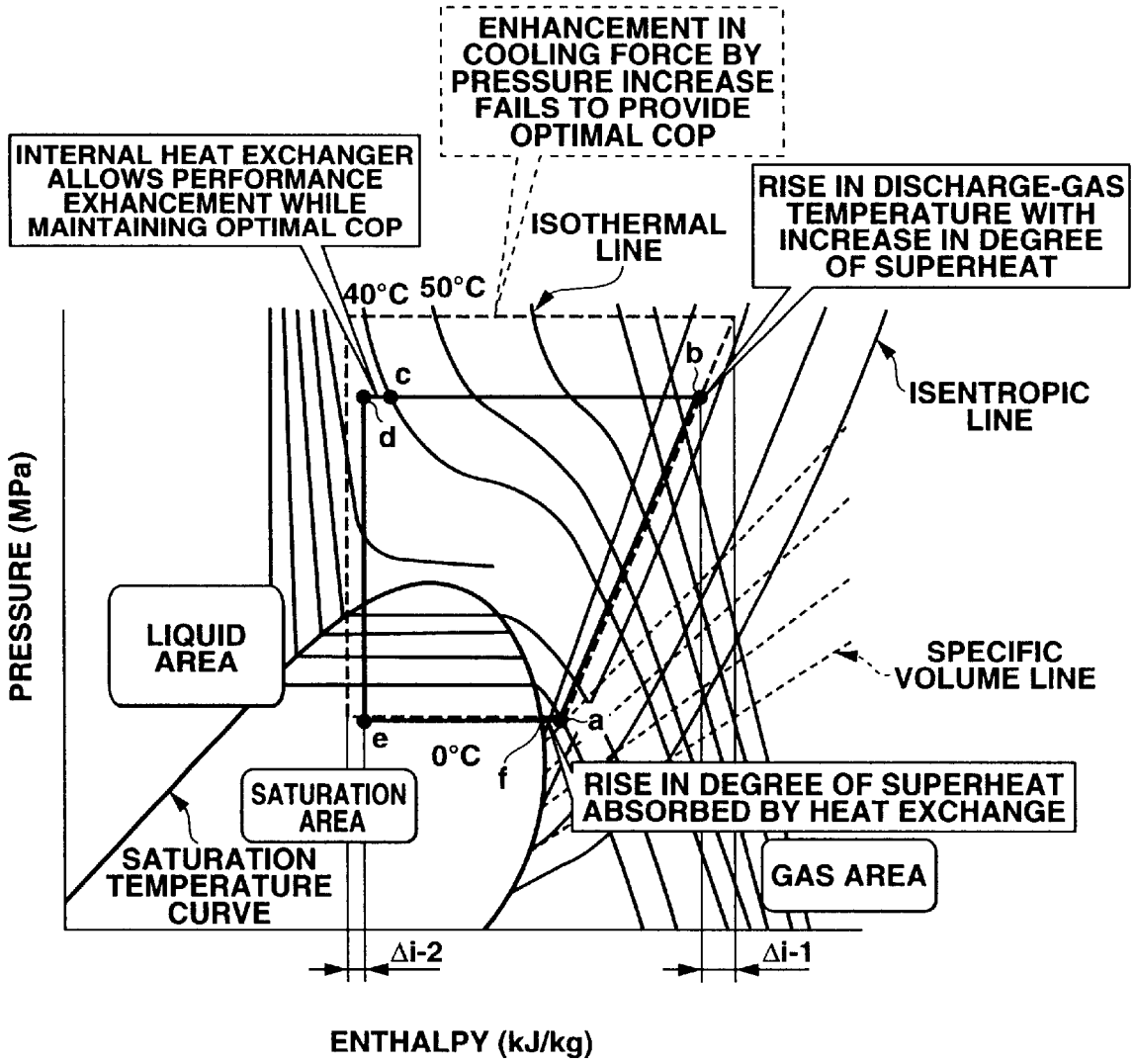
FIG. 4 is a view similar to FIG. 2, illustrating a Mollier diagram for explaining the cooling cycle of $CO_2$ refrigerant.

Referring to FIG. 4, our study reveals that when controlling the operating conditions of the cooling cycle in accordance with the temperature and pressure of refrigerant between the gas cooler and the internal heat exchanger, i.e. at point "c", optimal COP can be preserved without being influenced by the heat-receiving amount of the internal heat exchanger. On the other hand, when controlling the operating conditions in accordance with the temperature and pressure of refrigerant at an outlet of the internal heat exchanger, i.e. at point "d" or at an inlet of a throttling device, COP includes an enthalpy variation due to the internal heat exchanger as seen from FIG. 4, leading to control failing to providing optimal COP.

Figure 5:
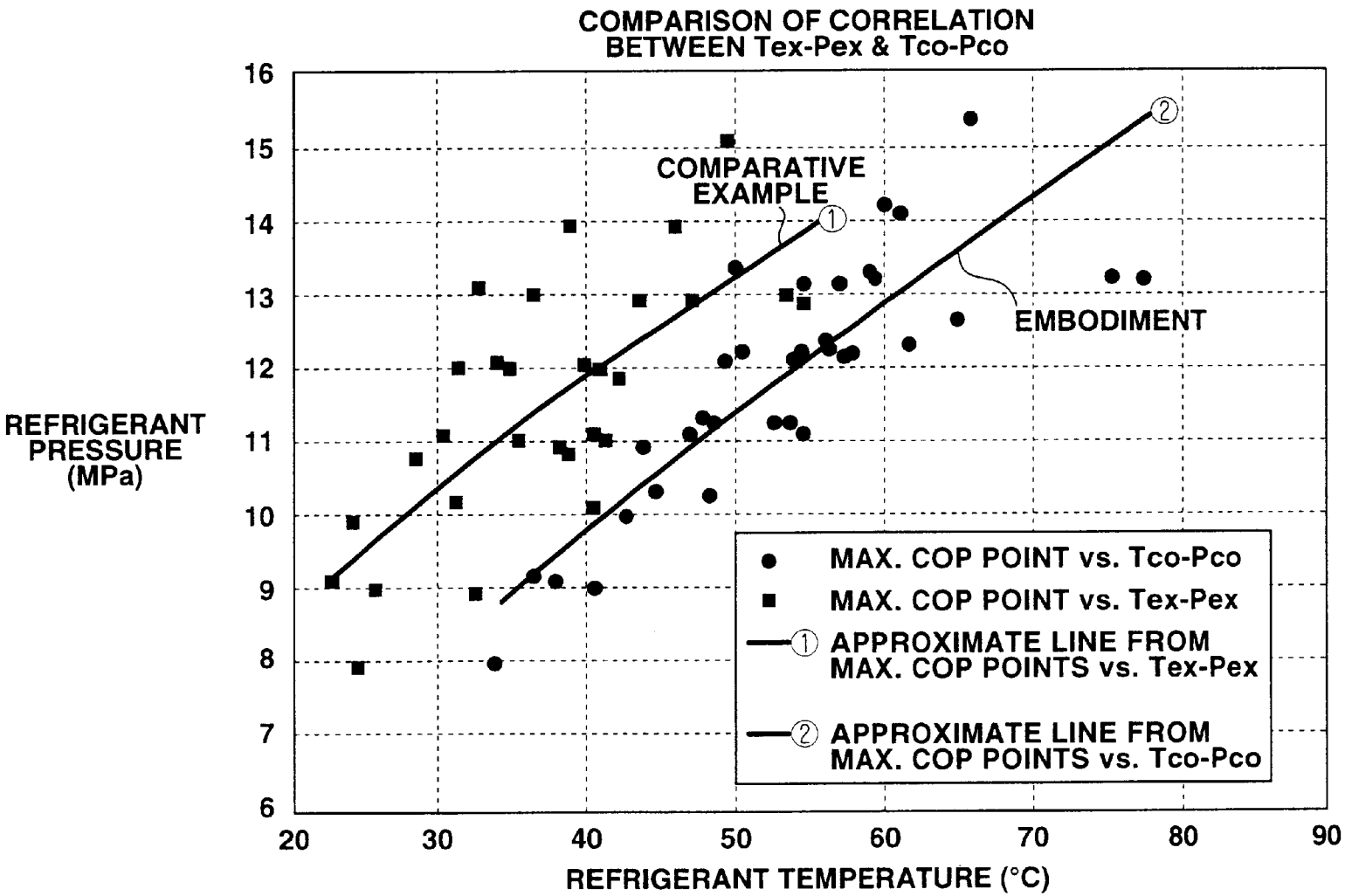
FIG. 5 is a view similar to FIG. 4, for explaining the effect of the present invention.

The above observation was confirmed experimentally. Referring to FIG. 5, in the illustrative embodiment, maximum COP points with respect to a refrigerant temperature Tco and a refrigerant pressure Pco between the gas cooler and the internal heat exchanger are plotted by circular spots ●. On the other hand, in a comparative example, maximum COP points with respect to a refrigerant temperature Tex and a refrigerant pressure Pex at the inlet of the throttling device are plotted by rectangular spots ■. Approximate lines ①, ② are obtained from the maximum COP points vs. Tco-Pco and the maximum COP points vs. Tex-Pex. As for a coefficient of correlation, it was 0.76 in the case given by circular spots, and 0.56 in the case given by rectangular spots. As is apparent from this result, optimal COP providing control can be achieved according to the present invention wherein the operating conditions of the cooling cycle are controlled in accordance with the refrigerant temperature Tco and the refrigerant pressure Pco between the gas cooler and the internal heat exchanger.

Moreover, in the cooling cycle according to the present invention, the operating conditions are controlled through switching between at least two control expressions, i.e. a first control expression giving high priority to COP and a second control expression giving high priority to the cooling capacity or force, in accordance with the operating environments.

Referring to FIG. 4, assuming that the flow rate of refrigerant is constant, the rate of change of COP is determined by the slope of an isentropic line of the compressor and an isothermal line at an outlet of the gas cooler. Since supercritical refrigerants such as $CO_2$ are put to use in a supercritical area, there is, in a range with small slope of the isothermal line, a section where the increment of power of the compressor is smaller than that of the cooling capacity. This means that the pressure providing maximum COP exists for each refrigerant temperature at the gas-cooler outlet. On the other hand, the cooling capacity increases with a pressure increase until the isothermal line is parallel to the pressure axis. That is, a maximum efficiency point where maximum COP is provided does not coincide with a maximum cooling-force point where maximum cooling capacity is provided.

Referring to FIG. 4, assuming that the flow rate of refrigerant is constant, the reason why the pressure providing maximum COP exists for each temperature at the gas-cooler outlet is described. In the Mollier diagram shown in FIG. 4, a particular pattern is given by a solid line, and another pattern with the pressure of high-pressure side refrigerant increased is given by a broken line. Since the flow rate of refrigerant is constant, the increment of power of the compressor required to change from the state shown by the solid line to the state shown by the broken line is given by Δi-1. Moreover, the increment of the cooling capacity or performance of an evaporator is given by Δi-2.

Point "e" for an inlet of the evaporator is changed by changing point "d" for a high-pressure side outlet of the internal heat exchanger, which is, in turn, changed by changing point "c" for the outlet of the gas cooler. Gas-cooler-outlet point "c" is changed with the temperature of cooling air for the gas cooler. Thus, if the efficiency of the gas cooler is 100%, the temperature of the refrigerant at the gas-cooler outlet is the same as that of the cooling air. Therefore, when varying the pressure, gas-cooler-outlet point "c" is moved on the isothermal line.

It will be understood from above that the pressure exists at which Δi-2 is smaller than Δi-1. This pressure is pressure providing maximum COP with respect to the temperature of refrigerant at the gas-cooler outlet. At further high pressure, the isothermal line is parallel to the pressure axis, so that even if the power of the compressor is increased to further increase the pressure of high-pressure side refrigerant, the increment of the cooling capacity Δi-2 is zero. Thus, this pressure is the pressure providing maximum cooling capacity.

Figure 2:
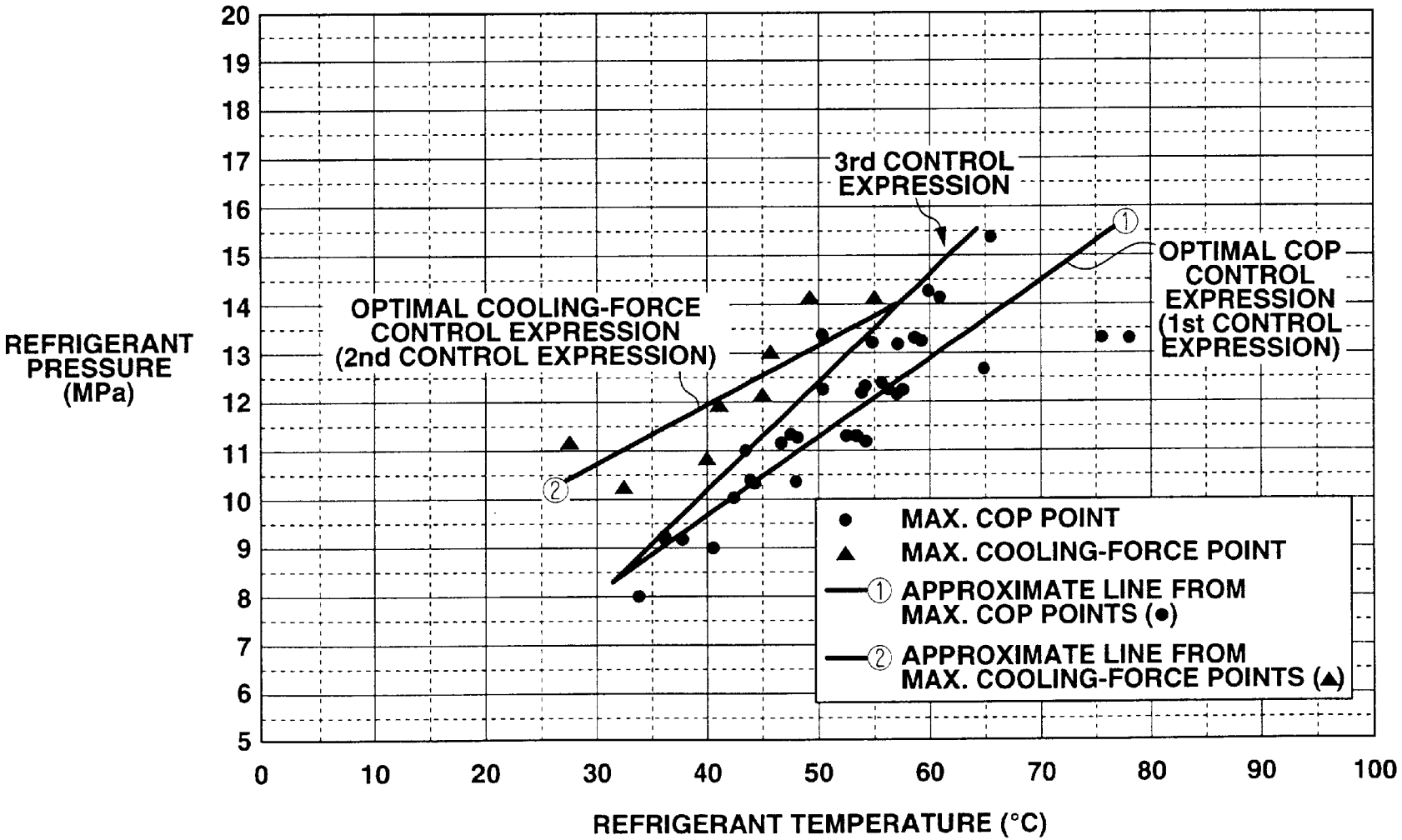
FIG. 2 is a graph illustrating a control map used in the embodiment.

In view of the foregoing, referring to FIG. 2, in the cooling cycle according to the present invention, the operating conditions are controlled through switching between the first control expression giving high priority to the maximum efficiency point or COP and the second control expression giving high priority to the maximum cooling-force point or cooling capacity as the need arises.

By way of example, when the cabin temperature is higher, and thus an evaporator is subjected to a greater heat load, switching is carried out from control using the first control expression giving high priority to COP to control using the second control expression giving high priority to the cooling capacity, regulating the operating conditions of the cooling cycle. With this, a cooling force demanded by passengers or occupants can be secured even with poor efficiency of the compressor.

Moreover, referring to FIG. 2, in the cooling cycle according to the present invention, the relationship between the temperature and pressure of high-pressure side refrigerant can be controlled by using a third control expression obtained by connecting a lower limit of the first control expression and an upper limit of the second control expression.

Next, referring to FIGS. 1–2 and 4–5, a detailed description is made with regard to preferred embodiments of the cooling cycle according to the present invention.

Figure 1:
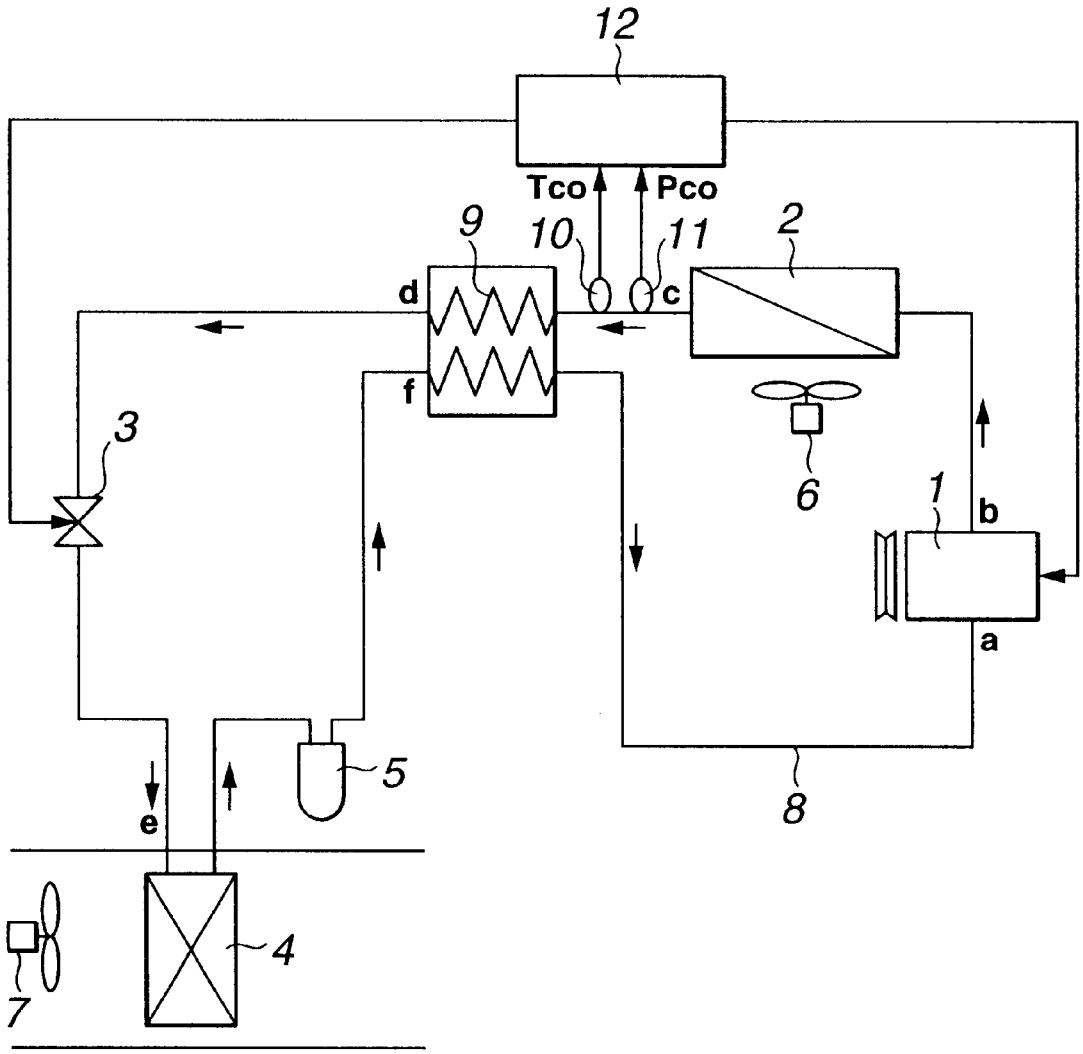
FIG. 1 is a circuit diagram showing an embodiment of a control cycle for use in automotive air-conditioning systems according to the present invention.

Referring to FIG. 1, the cooling cycle comprises a compressor 1, a gas cooler 2, an internal heat exchanger 9, a pressure control valve or throttling means 3, an evaporator or heat sink 4, and a trap or accumulator 5, which are connected in this order by means of a refrigerant line 8 to form a closed circuit.

The compressor 1 is driven by a prime mover such as an engine or motor to compress $CO_2$ refrigerant in the gaseous phase, which is discharged to the gas cooler 2. Tile compressor 1 may be of any type such as: (a) a variable-displacement type wherein automatic control of the discharge quantity and pressure of the refrigerant is carried out, internally air externally, in accordance with the conditions of the refrigerant in a cooling cycle; (b) a constant-displacement type with rotational-speed control capability; or (c) the like.

The gas cooler 2 carries out heat exchange between $CO_2$ refrigerant compressed by the compressor 1 and the outside air or the like for cooling of the refrigerant. The gas cooler 2 is provided with a cooling fan 6 for allowing acceleration of heat exchange or implementation thereof even when a vehicle is at a standstill. In order to cool refrigerant within the gas cooler 2 up to the outside-air temperature as closely as possible, the gas cooler 2 is arranged at the front of the vehicle, for example.

The internal heat exchanger 9 carries out heat exchange between $CO_2$ refrigerant flowing from the gas cooler 2 and the refrigerant flowing from the trap 5. During operation, heat is dissipated from the former refrigerant to the latter refrigerant.

The pressure control valve or pressure-reducing valve 3 reduces the pressure of $CO_2$ refrigerant by making high-pressure (about 10 MPa) refrigerant flowing from the internal heat exchanger 9 pass through a pressure-reducing hole. The pressure control valve 3 carries out not only pressure reduction of refrigerant, but pressure control thereof at the outlet of the gas cooler 2. Refrigerant with the pressure reduced by the pressure control valve 3, which is in the two-phase (gas-liquid) state, flows into the evaporator 4. The pressure control valve 3 may be of any type such as duty-ratio control type wherein the opening/closing duty ratio of the pressure-reducing hole is controlled by means of an electric signal, etc. An example of the pressure control valve 3 of the type is disclosed in Japanese Patent Application 2000-206780 filed Jul. 7, 2000, the entire teachings of which are incorporated hereby by reference.

The evaporator 4 is accommodated in a casing of an automotive air-conditioning unit, for example, to provide cooling for air spouted into a cabin of the vehicle. Air taken in from the outside or the cabin by a fan 7 is cooled during passage through the evaporator 4, which is discharged from a spout, not shown, to a desired position in the cabin. Specifically, when evaporating or vaporizing in the evaporator 4, the two-phase $CO_2$ refrigerant flowing from the pressure control valve 3 absorbs latent heat of vaporization from introduced air for cooling thereof.

The trap 5 separates $CO_2$ refrigerant that has passed through the evaporator 4 into a gaseous-phase portion and a liquid-phase portion. Only the gaseous-phase portion is returned to the compressor 1, and the liquid-phase portion is temporarily accumulated in the trap 5.

Referring to FIGS. 1 and 4, the operation of the cooling cycle is described. Gaseous-phase $CO_2$ refrigerant is compressed by the compressor 1 (a–b). Gaseous-phase refrigerant with high temperature and high pressure is cooled by the gas cooler 2 (b–c), which is further cooled by the internal heat exchanger 9 (c–d). Then, the refrigerant is reduced in pressure by the pressure control valve 3 (d–e), which makes the refrigerant fall in the two-phase (gas-liquid) state. Two-phase refrigerant is evaporated in the evaporator 4 (e–f) to absorb latent heat of vaporization from introduced air for cooling thereof. Such operation of the cooling cycle allows cooling of air introduced in the air-conditioning unit, which is spouted into the cabin for cooling thereof.

In the trap 5, $CO_2$ refrigerant that has passed through the evaporator 4 is separated into a gaseous-phase portion and a liquid-phase portion. Only the gaseous-phase portion passes through the internal heat exchanger 9 to absorb heat (f-a), and is inhaled again in the compressor 1.

In the illustrative embodiment, the cooling cycle comprises a temperature sensor 10 for sensing the temperature of the high-pressure side refrigerant between the gas cooler 2 and the internal heat exchanger 9, and a pressure sensor 11 for sensing the pressure of the high-pressure side refrigerant between the two. The cooling cycle is controlled as hereafter described in detail.

Referring to FIG. 2, a refrigerant temperature Tco at the outlet of the gas cooler 2 which is detected by the temperature sensor 10, and a refrigerant pressure Pco at the outlet of the gas cooler 2 which is detected by the pressure sensor 11 are provided to a controller 12 which controls the opening degree of the pressure control valve 3 and/or the compressor 1 with reference to a control map shown in FIG. 2.

The control map shown in FIG. 2 provides a control expression for optimally controlling COP of the cooling cycle, which corresponds to a first control expression, and a control expression for optimally controlling a cooling force, which corresponds to a second control expression. The optimal COP control expression is an approximation from the maximum COP points plotted by circular spots (•), whereas the optimal cooling-force control expression is an approximation from the maximum cooling-force points plotted by triangular spots (▲). The centerline for each control expression is determined as hereafter described in detail.

Optimal COP control expression: $Pco=0.777\times Tco^{0.684}$

Optimal cooling-force control expression: $Pco=2.303\times Tco^{0.447}$

Figure 6:
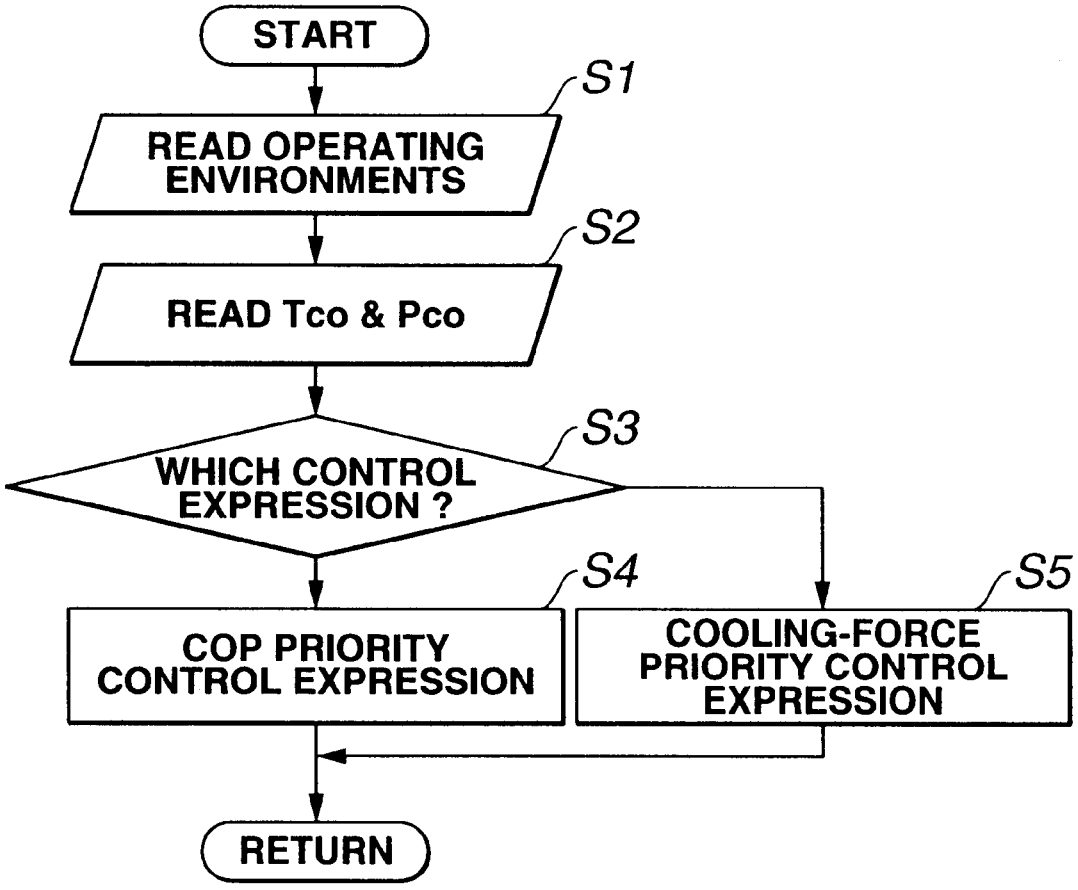
FIG. 6 is a flowchart showing a control procedure carried out in a controller.

Referring to FIG. 6, a control procedure carried out in the controller 12 is described. At a step S1, operating environments are read such as refrigerant pressure in the evaporator 4 and the cooling cycle, outside-air temperature and cabin set temperature. At a step S2, the refrigerant temperature Tco and the refrigerant pressure Pco are read from the temperature sensor 10 and the pressure sensor 11, respectively.

At a step S3, in accordance with the operating environments read at the step S1, it is determined which is preferable in the current conditions, control giving high priority to COP or control giving high priority to a cooling force.

By way of example, during control using the COP priority control expression, when the cabin temperature is higher and thus the evaporator 4 is subjected to a greater heat load, switching to control using the cooling-force priority expression is carried out to regulate the operating conditions of the cooling cycle. With this, a cooling force demanded by passengers or occupants can be secured even with poor efficiency of the compressor 1.

At steps S4 and S5, using the control expression selected at the step S3, the pressure control valve 3 and/or the compressor 1 is controlled so that the relationship between the refrigerant temperature Tco detected by the temperature sensor 10 and the refrigerant pressure Pco detected by the pressure sensor 11 provides values with the selected control expression shown in FIG. 2.

Specifically, the refrigerant temperature Tco detected by the temperature sensor 10 is substituted into the control expression shown in FIG. 2 to obtain the target refrigerant pressure Pco. The pressure control valve 3 and/or the compressor 1 is controlled so that the actual refrigerant pressure detected by the pressure sensor 11 coincides with the target refrigerant pressure.

As for control of the pressure control valve 3 and/or the compressor 1, control may be carried out for only the pressure control valve 3 or the compressor 1 or both of the pressure control valve 3 and the compressor 1. Principally, control of the pressure control valve 3 is based on regulating opening/closing of the pressure-reducing hole, whereas control of the compressor 1 is based on regulating the discharge volume per rotation and the rotation.

In the illustrative embodiment, the temperature and pressure of the high-pressure side refrigerant are controlled through switching between the first and second control expressions. Optionally, the temperature and pressure of the high-pressure side refrigerant may be controlled in accordance with only a third control expression taking advantages of the two control expressions, i.e., expression obtained by connecting a lower limit of the first control expression and an upper limit of the second control expression, as shown in FIG. 2.

Having described the present invention in connection with the preferred embodiment, it is to be understood that the present invention is not limited thereto, and various changes and modifications can be made without departing from the scope of the present invention.

By way of example, in the illustrative embodiment, the pressure control valve is of the electric type. Alternatively, the pressure control valve may be of the mechanical expansion type wherein the valve opening degree is adjusted by detecting the pressure and temperature of the high-pressure side refrigerant. In this alternative, a high-pressure side refrigerant pressure detecting part and a high-pressure side refrigerant temperature detecting part are arranged to ensure communication between a valve main body and the gas cooler 2 and the internal heat exchanger 9.

Figure 3:
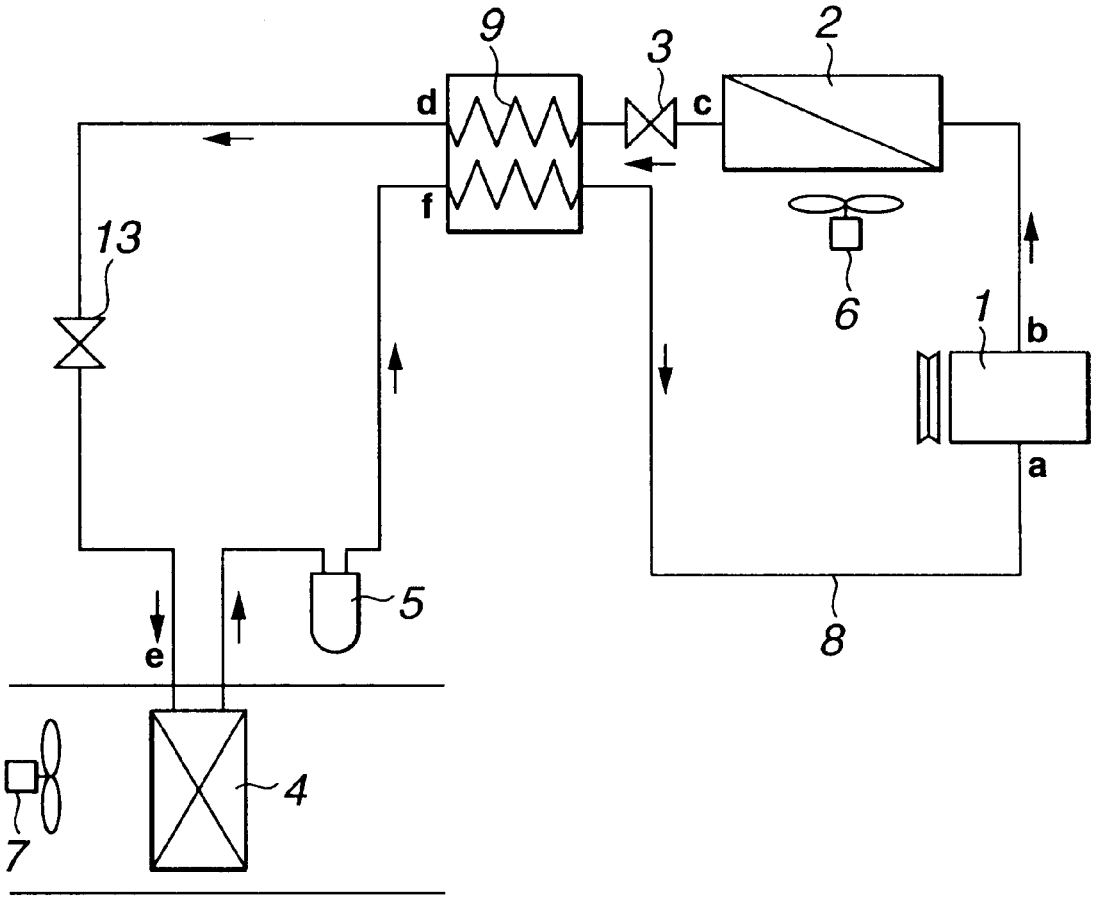
FIG. 3 is a view similar to FIG. 1, showing another embodiment of the present invention.

Moreover, referring to FIG. 3, the pressure control valve or throttling means 3 may be arranged in the refrigerant line 8 between the gas cooler 2 and the internal heat exchanger 9. In this embodiment, the cooling cycle further comprises a stationary pressure-reducing valve 13 which has a pressure-reducing hole with a constant opening degree and which is arranged upstream of the evaporator 4. The opening degree of the pressure control valve 3 is controlled in accordance with the refrigerant temperature Tco and the refrigerant pressure Pco between the gas cooler 2 and the internal heat exchanger 9. In view of possible simplification of the part constitution, it is preferable to use, as the pressure control valve 3, a valve including a temperature sensor and a pressure sensor disclosed, e.g., in U.S. Pat. No. 5,890,370 issued Apr. 6, 1999 to Sakakibara et al.

The entire teachings of Japanese Patent Application 2000-330361 filed Oct. 30, 2000 are incorporated hereby by reference.

What is claimed is:

1. A cooling cycle with a high-pressure side operating in a supercritical area of a refrigerant, comprising:

a compressor that compresses the refrigerant;

a gas cooler that cools the compressed refrigerant;

a throttling device that throttles flow of the cooled refrigerant;

an evaporator that cools intake air by a heat absorbing action of the cooled refrigerant;

an internal heat exchanger that carries out heat exchange between the cooled refrigerant and the refrigerant that passed through the evaporator;

a temperature sensor that senses a temperature of the cooled refrigerant between the gas cooler and the internal heat exchanger;

a pressure sensor that senses a pressure of the cooled refrigerant between the gas cooler and the internal heat exchanger; and a controller that controls at least one of the compressor and the throttling device in accordance with the sensed temperature of the cooled refrigerant and the sensed pressure of the cooled refrigerant, wherein a relationship between the sensed temperature and the sensed pressure satisfies one of at least two control expressions, the at least two control expressions comprising a first control expression giving high priority to a coefficient of performance (COP), and a second control expression giving high priority to a cooling capacity.

2. The cooling cycle as claimed in claim 1, wherein the first control expression provides an area with $P=0.777\times T^{0.684}$ as center, where T is the sensed temperature, and P is the sensed pressure.

3. The cooling cycle as claimed in claim 1, wherein the second control expression provides an area with $P=2.303\times T^{0.447}$ as center, where T is the sensed temperature, and P is the sensed pressure.

4. The cooling cycle as claimed in claim 1, wherein when the controller determines that operating environments of the cooling cycle require control giving high priority to the cooling capacity, the relationship between the sensed temperature and the sensed pressure is switched from the first control expression to the second control expression.

5. The cooling cycle as claimed in claim 4, wherein the operating environments comprise an outside-air temperature and a cabin set temperature.

6. The cooling cycle as claimed in claim 1, wherein the at least two control expressions further comprise a third control expression obtained by connecting a lower limit of the first control expression and an upper limit of the second control expression, wherein the third control expression is always available for control of at least one of the compressor and the throttling device.

7. The cooling cycle as claimed in claim 1, wherein the throttling device is interposed between the internal heat exchanger and the evaporator.

8. The cooling cycle as claimed in claim 1, wherein the throttling device comprises a valve having an opening degree controlled in accordance with the sensed temperature and the sensed pressure.

9. A cooling cycle with a high-pressure side operating in a supercritical area of a refrigerant, comprising:

a compressor that compresses the refrigerant;

a gas cooler that cools the compressed refrigerant;

a throttling device that throttles flow of the cooled refrigerant;

an evaporator that cools intake air by a heat absorbing action of the cooled refrigerant;

an internal heat exchanger that carries out heat exchange between the cooled refrigerant and the refrigerant that passed through the evaporator;

a temperature sensor that senses a temperature of the cooled refrigerant between the gas cooler and the internal heat exchanger;

a pressure sensor that senses a pressure of the cooled refrigerant between the gas cooler and the internal heat exchanger; and a controller that controls at least one of the compressor and the throttling device in accordance with the sensed temperature of the cooled refrigerant and the sensed pressure of the cooled refrigerant, wherein the throttling device is interposed between the gas cooler and the internal heat exchanger.

10. The cooling cycle as claimed in claim 9, wherein a relationship between the sensed temperature and the sensed pressure satisfies one of at least two control expressions, and wherein the at least two control expressions comprise a first control expression giving high priority to a coefficient of performance (COP) and a second control expression giving high priority to a cooling capacity.

11. A method of controlling a cooling cycle with a high-pressure side operating in a supercritical area of a refrigerant, the cooling cycle comprising:

a compressor that compresses the refrigerant;

a gas cooler that cools the compressed refrigerant;

a throttling device that throttles flow of the cooled refrigerant;

an evaporator that cools intake air by a heat absorbing action of the cooled refrigerant; and an internal heat exchanger that carries out heat exchange between the cooled refrigerant and the refrigerant that passed through the evaporator, the method comprising:

sensing a temperature of the cooled refrigerant between the gas cooler and the internal heat exchanger and a pressure of the cooled refrigerant between the gas cooler and the internal heat exchanger;

determining a control pattern of the cooling cycle in accordance with operating environments of the cooling cycle; and controlling at least one of the compressor and the throttling device in accordance with the determined control pattern, the controlling step allowing adjustment of the temperature of the cooled refrigerant and the pressure of the cooled refrigerant, wherein the control pattern comprises at least two control expressions, wherein the at least two control expressions comprise a first control expression giving high priority to a coefficient of performance (COP) and a second control expression giving high priority to a cooling capacity, and wherein a relationship between the sensed temperature and the sensed pressure satisfies one of the at least two control expressions.

12. The method as claimed in claim 11, wherein the first control expression provides an area with $P=0.777\times T^{0.684}$ as center, where T is the sensed temperature, and P is the sensed pressure.

13. The method as claimed in claim 11, wherein the second control expression provides an area with $P=2.303\times T^{0.447}$ as center, where T is the sensed temperature, and P is the sensed pressure.

14. The method as claimed in claim 11, wherein when it is determined that the operating environments require control giving high priority to the cooling capacity, the relationship between the sensed temperature and the sensed pressure is switched from the first control expression to the second control expression.

15. The method as claimed in claim 11, wherein the operating environments comprise an outside-air temperature and a cabin set temperature.

16. The method as claimed in claim 11, wherein the control pattern further comprises a third control expression obtained by connecting a lower limit of the first control expression and an upper limit of the second control expression.

17. A cooling cycle with a high-pressure side operating in a supercritical area of a refrigerant, comprising:

a compressor that compresses the refrigerant;

a gas cooler that cools the compressed refrigerant;

means for throttling flow of the cooled refrigerant;

an evaporator that cools intake air by heat absorbing action of the cooled refrigerant;

an internal heat exchanger that carries out heat exchange between the cooled refrigerant and the refrigerant that passed through the evaporator;

means for sensing a temperature of the cooled refrigerant between the gas cooler and the internal heat exchanger;

means for sensing a pressure of the cooled refrigerant between the gas cooler and the internal heat exchanger; and means for controlling at least one of the compressor and the throttling means in accordance with the sensed temperature of the cooled refrigerant and the sensed pressured of the cooled refrigerant, wherein a relationship between the sensed temperature and the sensed pressure satisfies one of at least two control expressions, and wherein the at least two control expressions comprises a first control expression giving high priority to a coefficient of performance (COP), and a second control expression giving high priority to a cooling capacity.

18. A method of controlling a cooling cycle with a high-pressure side operating in a supercritical area of a refrigerant, the cooling cycle comprising:

a compressor that compresses the refrigerant;

a gas cooler that cools the compressed refrigerant;

a throttling device that throttles flow of the cooled refrigerant;

an evaporator that cools intake air by a heat absorbing action of the cooled refrigerant; and an internal heat exchanger that carries out heat exchange between the cooled refrigerant and the refrigerant that passed through the evaporator, the method comprising:

sensing a temperature of the cooled refrigerant between the gas cooler and the internal heat exchanger and a pressure of the cooled refrigerant between the gas cooler and the internal heat exchanger;

determining a control pattern of the cooling cycle in accordance with operating environments of the cooling cycle, the operating environments comprising an outside-air temperature and a cabin set temperature; and controlling at least one of the compressor and the throttling device in accordance with the determined control pattern, the controlling step allowing adjustment of the temperature of the cooled refrigerant and the pressure of the cooled refrigerant.

* * * * *